United States Patent [19]

Lauener

[11] Patent Number: 4,944,342

[45] Date of Patent: Jul. 31, 1990

[54] PROCESS AND DEVICE FOR COOLING ROLLERS

[75] Inventor: Wilhelm F. Lauener, Gerlafingen, Switzerland

[73] Assignee: Lauener Engineering AG, Thun, Switzerland

[21] Appl. No.: 428,486

[22] Filed: Oct. 31, 1989

Related U.S. Application Data

[63] Continuation of Ser. No. 251,708, filed as PCT CH 87/00171 on Dec. 14, 1987, published as WO88/04585 on Jun. 30, 1988, abandoned.

[30] Foreign Application Priority Data

Dec. 22, 1986 [CH] Switzerland ..... 05132/86

[51] Int. Cl.[5] ..... B22D 11/124

[52] U.S. Cl. ..... 164/485; 164/423; 164/428; 164/429; 164/443; 165/90

[58] Field of Search ..... 164/423, 428, 429, 443, 164/463, 477, 480, 485; 165/89, 90

[56] References Cited

U.S. PATENT DOCUMENTS

| | | | |
|---|---|---|---|
| 2,058,447 | 10/1936 | Hazelett . | |
| 2,693,012 | 11/1954 | Harris et al. . | |
| 2,850,776 | 9/1958 | Hunter . | |
| 2,936,158 | 5/1960 | Ramundo | 257/95 |
| 2,972,472 | 2/1961 | Konold | 257/95 |
| 3,498,591 | 3/1970 | Calkins | 165/89 |
| 4,506,727 | 3/1985 | Swasey | 165/90 |

FOREIGN PATENT DOCUMENTS

| | | | |
|---|---|---|---|
| 619491 | 5/1961 | Canada . | |
| 348241 | 8/1960 | Fed. Rep. of Germany . | |
| 3326746 | 2/1985 | Fed. Rep. of Germany . | |
| 682730 | 2/1930 | France . | |
| 58-168462 | 10/1983 | Japan | 164/428 |
| 58-221645 | 12/1983 | Japan | 164/485 |
| 429042 | 1/1967 | Switzerland . | |

OTHER PUBLICATIONS

E. Herrmann, Handbook on Continuous Casting, (1980), p. 64, FIG. 10.

*Primary Examiner*—Richard K. Seidel
*Attorney, Agent, or Firm*—Sheridan, Ross & McIntosh

[57] ABSTRACT

In rollers, especially those used for continuous casting of strips (40) of aluminum and other metals, the coolant flows between the roller shell (7) and the roller core (8) through axial cooling channels (26). The counterflow principle is here applied, so that the coolant alternatively flows in the cooling channels (26) from one front side (41, 41*a*) to the other and is discharged there. A bore divided into an axial channel (15) and into a tubular channel (16) for supplying and discharging the coolant extends from one front side of the roller (1) to the other front side. Alternating supply and discharge ducts for the cooling channels (26) that extend over the whole length of the roller core (8) are arranged in such a manner near both roller front sides that the coolant flows according to the counterflow principle. The cooling channels (26) are formed of longitudinal grooves in the core (8) and shell (7) of the roller.

21 Claims, 6 Drawing Sheets

PROCESS AND DEVICE FOR COOLING ROLLERS

This is a continuation of co-pending application Ser. No. 07/251,708, filed as PCT CH87/00171 on Dec. 14, 1987, published as WO88/04585 on Jun. 30, 1988 now abandoned.

The invention relates to a process and a device for cooling rollers, especially for continuous casting of strips of aluminum and other metals, with a coolant being guided through cooling channels arranged axially between a roller shell and a roller core.

When metal is continuously cast between two rollers, the casting mold is essentially formed by the gap between the rollers and lateral sealing walls. The application time of the rollers is relatively short, and a large amount of heat must be removed over a short distance. For this purpose, the rollers are cooled, either by spraying them from outside or by cooling them internally. Internal cooling of rollers is preferred for operational reasons.

When rollers are cooled internally, cooling channels are arranged as a rule between a roller core and a roller shell, through which channels a coolant flows. This coolant, cooling water as a rule, carries away heat from the roller shell. Considerable care must be devoted to the arrangement of the cooling channels, not only because they are responsible for the amount of heat drawn out of the material to be cooled, but also because they can determine the shape and/or dimensions of the rollers themselves during operation. If a roller is cooled to different degrees along its length or circumference, stresses will be produced by different amounts of thermal expansion. These stresses in turn may lead to different amounts of bending in the roller, which has a negative effect upon the quality of the rolling stock. In particular, however, considerable attention must be devoted to uniform cooling of the casting material lengthwise and transversely.

Swiss patent 429,042 teaches casting rollers in which the cooling channels run helically between the roller core and roller shell, said channels entering alternately at one end face of the roller or the other. The supply and discharge channels terminate in the same end face of the roller core.

A roller is also known from E. Hermann, Handbook on Continuous Casting, 1980, page 64, FIG. 10, in which the cooling channels run axially, with the supply and discharge channels terminating in the same end face of the roller core. The coolant, introduced at one roller end face, however, is deflected back at the other and used again for cooling as it moves in the opposite direction. This has the disadvantage that cooling is not uniform over the entire circumference of the roller because the coolant, flowing back in the opposite direction, already has a higher temperature because it has been considerably heated.

The goal of the inventor was to develop a process and a device for cooling rollers of the species recited hereinabove, which cool the rollers more uniformly lengthwise and transversely over the entire circumference of the shell.

This goal is achieved according to the invention, relative to the device, by feeding the coolant into the cooling channels alternately from one end face to the other using the counterflow principle, and carrying it away therefrom.

Preferably the coolant is guided through each two adjacent cooling channels, in alternating directions through channel pairs, using the counterflow principle.

According to the device, the goal is achieved relative to the invention by virtue of the fact that a bore, divided into an axial channel and a tubular channel to supply and/or carry away the coolant, extends from one end face of the roller to the vicinity of the other end face, and supply and discharge lines for the cooling channels extending over the entire length of the roller core, said channels being formed of lengthwise grooves in the roller core and roller shell, are so arranged alternately near the two roller end faces that the coolant flows according to the counterflow principle.

With respect to tool costs, it has been found advantageous to connect the alternately arranged supply and discharge lines for the coolant with each two adjacent cooling channels.

The bores, which branch off radially and alternately from the axial and/or tubular channels, advantageously lead to an interchangeable distributor flange abutting the roller body and flush externally therewith in the peripheral area, said flange conducting the coolant to the corresponding cooling channels and/or carrying it back from them. The introduction of the cold coolant into the cooling channels is accomplished in particular in individual channels or in alternating directions through channel pairs. At the other end face of the roller, the now heated coolant is received by the other distributing flange and returned to the tubular channel when the coolant is guided through the axial channel. If on the other hand the coolant is inserted through the tubular channel, the heated coolant is returned in the axial channel.

The distributor flange, which can be readily removed, also has the advantage that the cooling channels can be cleaned mechanically without removing the roller shell. The cooling channels can then be pushed out, for example, in simple fashion by using a suitable cleaning object.

In practice, 160 cooling channels are provided in casting rollers with an outer circumference of 600 millimeters and 240 cooling channels are provided in those with a circumference of 900 millimeters. This corresponds to a spacing of the cooling channels of approximately 12 millimeters on the shell surface. When the cooling channels are used according to the invention, an extraordinarily homogeneous temperature distribution is measured on the surface of the rollers lengthwise and transversely. Even when such two adjacent cooling channels are traversed by coolant in the same direction, assurance is provided that the same amount of heat is given off at every point on the roller shell. There is neither a change in the roller geometry nor adverse effects upon the quality of the cast strips as a result of temperature differences.

The invention will now be described in greater detail with reference to the examples shown in the drawing. The following are schematic diagrams:

FIG. 1: A partial cut-away view of a portion of a roll stand in the area of the roller bearing, with coolant supply and discharge;

Figure 1:
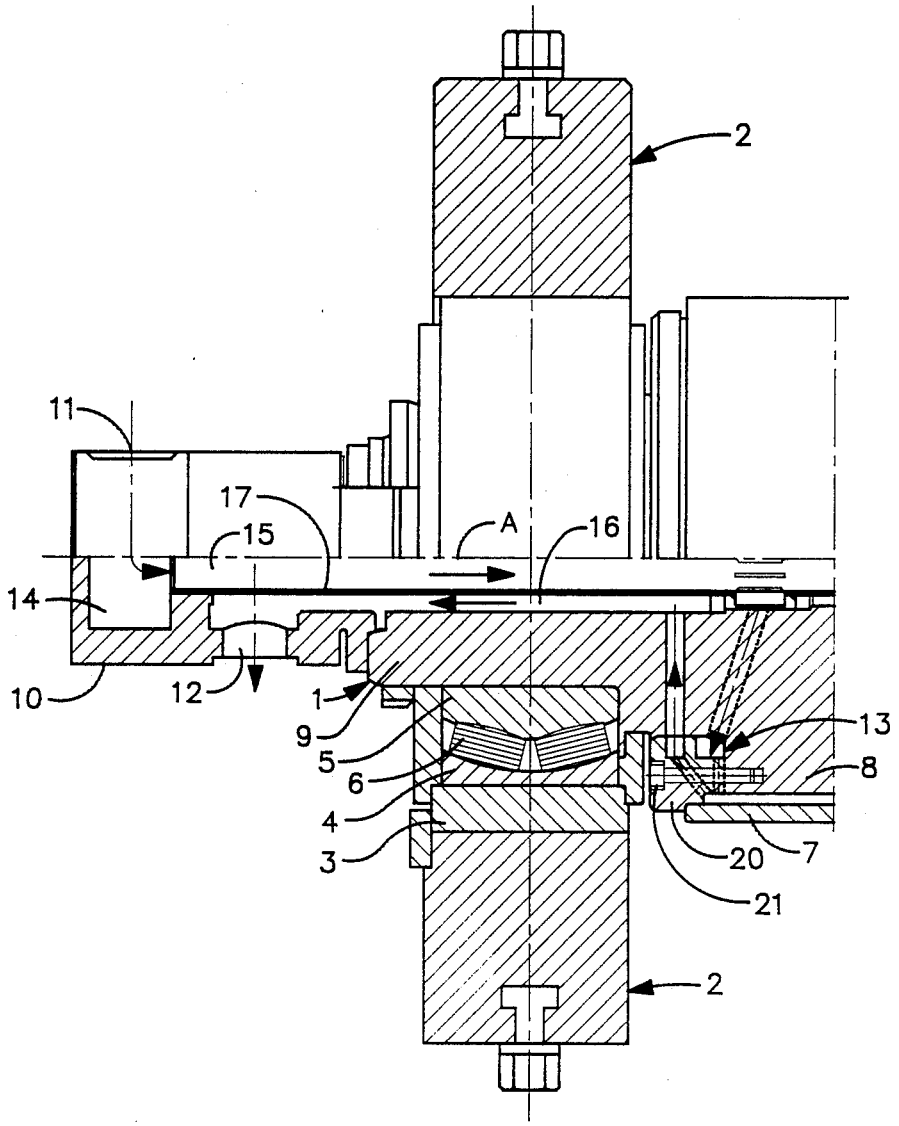

FIG. 1 shows a roller 1 mounted for rotation in a roll stand. For the sake of clarity, only one support frame 2 in the roll stand is shown. Rollers 6, which form a roller bearing, are located between the support frame and the roller, surrounded by a number of bearing shells 3, 4, and 5.

Roller 1 consists essentially of a roller shell 7 and a roller core 8, extended by a shoulder 13 into a projection 9. Projection 9 of the roller, mounted for rotation in support frame 2, is covered endwise by a gland 10, having an inlet opening 11 and an outlet for the coolant, cooling water in practice. Gland 10 has a collecting chamber 14 behind inlet opening 11, to which chamber an axial channel 15 connects. In the axial channel, the cooling water is guided parallel to the lengthwise axis A of the roller to the vicinity of the opposite end face of the roller. Axial channel 15 is surrounded by a tubular channel 16, which serves to return the heated cooling water and leads to outlet 12. Tubular channel 16 is separated from axial channel 15 by a channel wall 17 which is coaxial with respect to lengthwise axis A and is in the form of a shell.

In the transition area from roller core 8 to extension 9 the roller has mounted upon it a distributor flange 20 which is externally flush relative to the shell surface, said flange, connected to roller core 8 by screws 21, holding roller shell 7 and serving to distribute the cooling water. In FIG. 1, as well as the following figures, the direction of flow of the cooling water is indicated by arrows.

Figure 2:
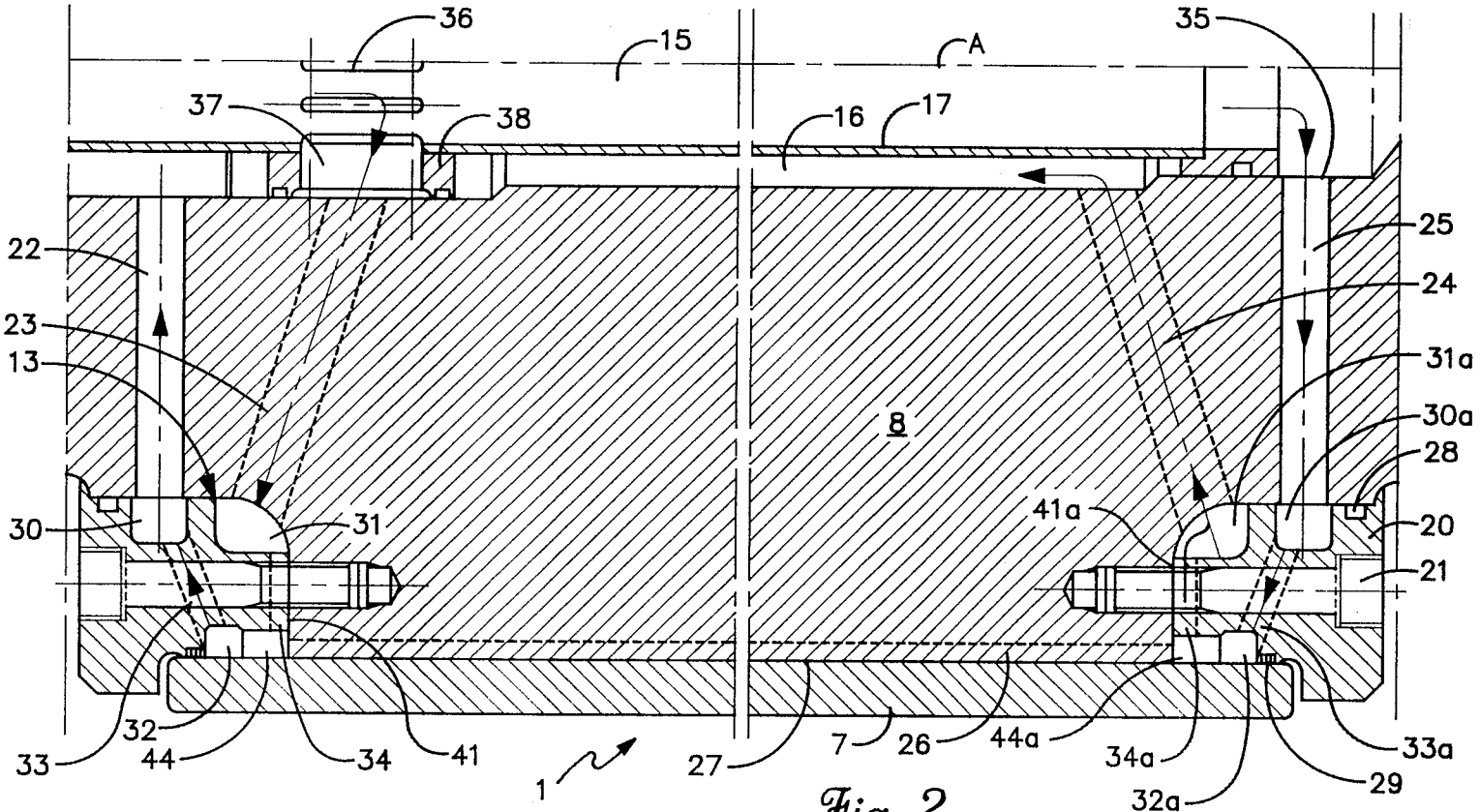
FIG. 2 shows an enlarged half lengthwise section through a roller shown shortened.

As shown in FIG. 2, roller core 8 itself contains bores 22, 23, 24, and 25 for conducting the cooling water from the central area to the peripheral area or back again from the latter. Only bores 22 and 25 lie in the plane of the section, while the other bores, 23 and 24, lie in a plane which is offset by a certain angle and runs through lengthwise axis A. This angle depends on the number of bores. However, there is always one bore that runs to axial channel 15 and one that runs to tubular channel 16 on the same plane which runs through roller lengthwise axis A. In practice the number of bores 22, 23, 24, and 25 is between 1 and half the number of cooling channels 26.

Cooling channels 26 which run axially to the roller are recessed in shell surface 27 in the form of grooves in roller core 8 which are open to the exterior. When the roller is ready to operate, they are covered by the inner surface of roller shell 7.

Distributor flange 20 is sealed by annular seals 28, 29 both from roller core 8 and from roller shell 7. Annular grooves recessed in distributor flange 20, together with the abutting surface of roller core 8 and/or shell 7, form three annular channels.

Bores 22, 25 terminate in inner annular channels 30, 30*a* which are further away from the outer end faces 41, 41*a* of the roller;

Bores 23, 24 terminate in the inner annular channels 31, 31*a* which are adjacent to the outer end faces 41, 41*a* of the roller, and Cooling channels 26 termiate alternately in outer annular channels 32, 32*a*.

Further away from roller end faces 41, 41*a* are the inner annular channels, 30, 30*a*, via branch channels 33, 33*a* which, passing radially through a distributor flange 20, extend diagonally inward and terminate in the corresponding outer annular channel 32, 32*a*. From the outer inner annular channels 31, 31*a* branch linees 34, 34*a* run radially to the ends of cooling channels 26 which are not connected with outer annular channels 32, 32*a*. Branch channels 34, 34*a* are grooves cut in the inner end face of distributor flange 20, said grooves being covered in a sealing fashion by a flat end face 41, 41*a* of roller body 8 resting upon them.

According to the version shown in FIG. 2, each cooling channel 26 is connected at both ends with an outer annular channel 32, 32*a* or a branch channel 34, 34*a*. The cooling channels are connected alternately to outer annular channels 32, 32*a* and branch channels 34, 34*a*.

The cooling water which enters the roller in axial channel 15 can therefore flow alternately through two circuits.

The cooling water flows through the center of the roller for its entire length, enters bore(s) 25 through outlet opening 35, and flows into inner annular channel 30*a*, then through branch channel 33*a* and outer annular channel 32*a*, and then goes through pockets 44*a* into two cooling channels 26, with two cooling channels being alternately connected and two not being connected. As it is heated, the cooling water flows toward the other end face 41 of the roller, emerges through pockets 44, collects in outer annular channel 32, flows through branch channels 33 to annular channel 30, and is finally conducted to tubular channel 16 via bore(s) 22, through which channel 16 the heated cooling water together with the remaining used cooling water emerges from the roller.

The other part of the fresh cooling water passes lengthwise through outlet openings 36 into bore(s) 23, and covers the distance between the inner annular channel 31 and branch channels 34 to the ends of cooling channels 26 which are not connected with outer annular channel 32. As it is heated again, the water flows through cooling channels 26 to the other end face 41*a*, where it enters branch channels 34*a* and then flows through inner annular channel 31*a* and bore(s) 24 to annular channel 16.

The cooling water which escapes from axial channel 15 through elongated outlet openings 36 collects in an annular chamber 37. The latter is sealed off from tubular channel 16 by wall elements 38, with individual segments of annular chamber 37 permitting the passage of heated cooling water flowing back in tubular channel 16.

Care must be devoted to ensuring that no back pressure is created anywhere when dimensioning all the passageway cross sections in the circuits.

Figure 3:
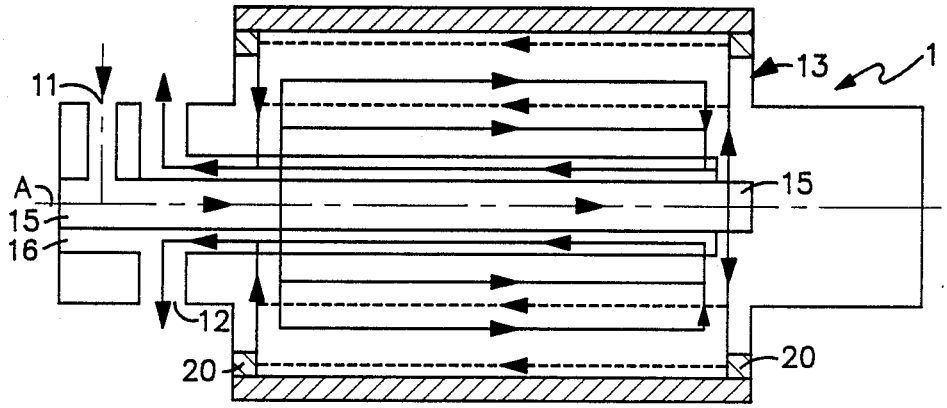
FIG. 3 is a stylized representation of the flow of the cooling water in a roller.

The coolant circuits described above are again shown in stylized form in FIG. 3. The alternate flow direction of the circuits is readily apparent.

Figure 4:
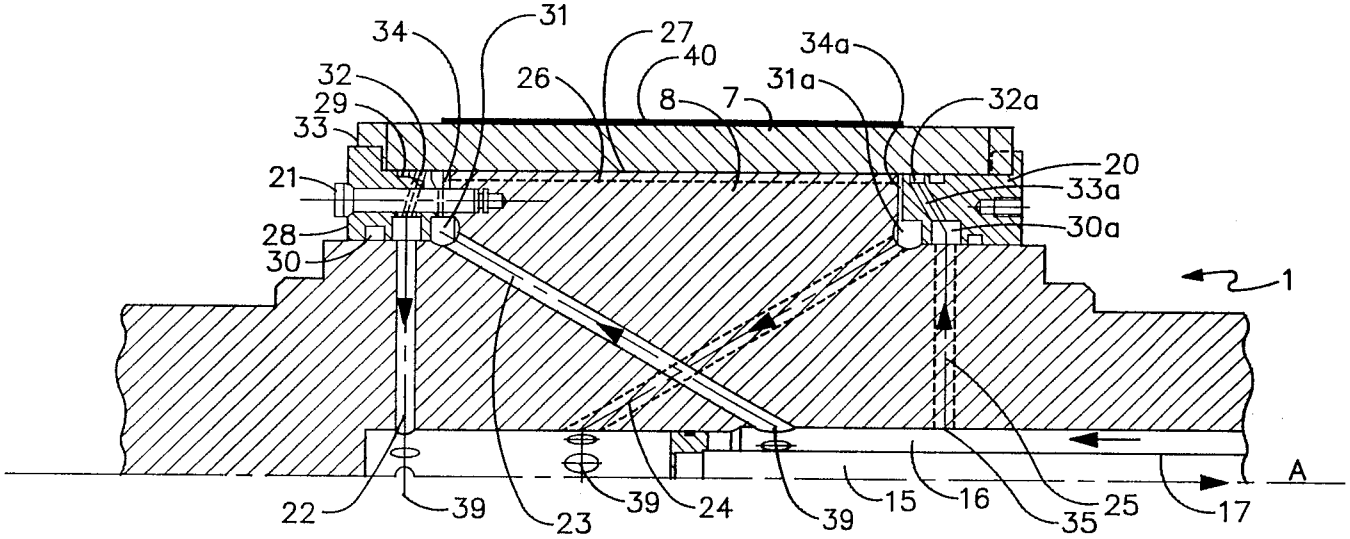
FIG. 4 is another enlarged half lengthwise section through a roller shown shortened.

FIG. 4 shows a version of the coolant supply up to distributor flanges 20 and/or the coolant discharge. The cooling water is supplied through tubular channel 16, which extends only over a portion of lengthwise axis A of roller 1. Cooling water is supplied to the inner annular channel 30*a* of one distributor flange 20 by means of eight bores 25 at right angles to lengthwise axis A. Cooling water is supplied to the inner annular channel 31 of the other distributor channel 20 which is located at the other end wall of roller 1, likewise through eight radial channels 23 running diagonally.

The heated cooling water is drained off in axial channel 15 which occupies the entire bore for a portion of the lengthwise axis of the roller. Each eight bores 22 and 24 pass through roller body 8 in a manner analogous to bores 23 and 25.

The arrangement according to FIG. 4 has the advantage that no annular chamber 37 as shown in FIG. 2, with intersecting cooling water, need be provided. A stiffening aluminum strip 40 is shown on roller shell 7.

Figure 5:
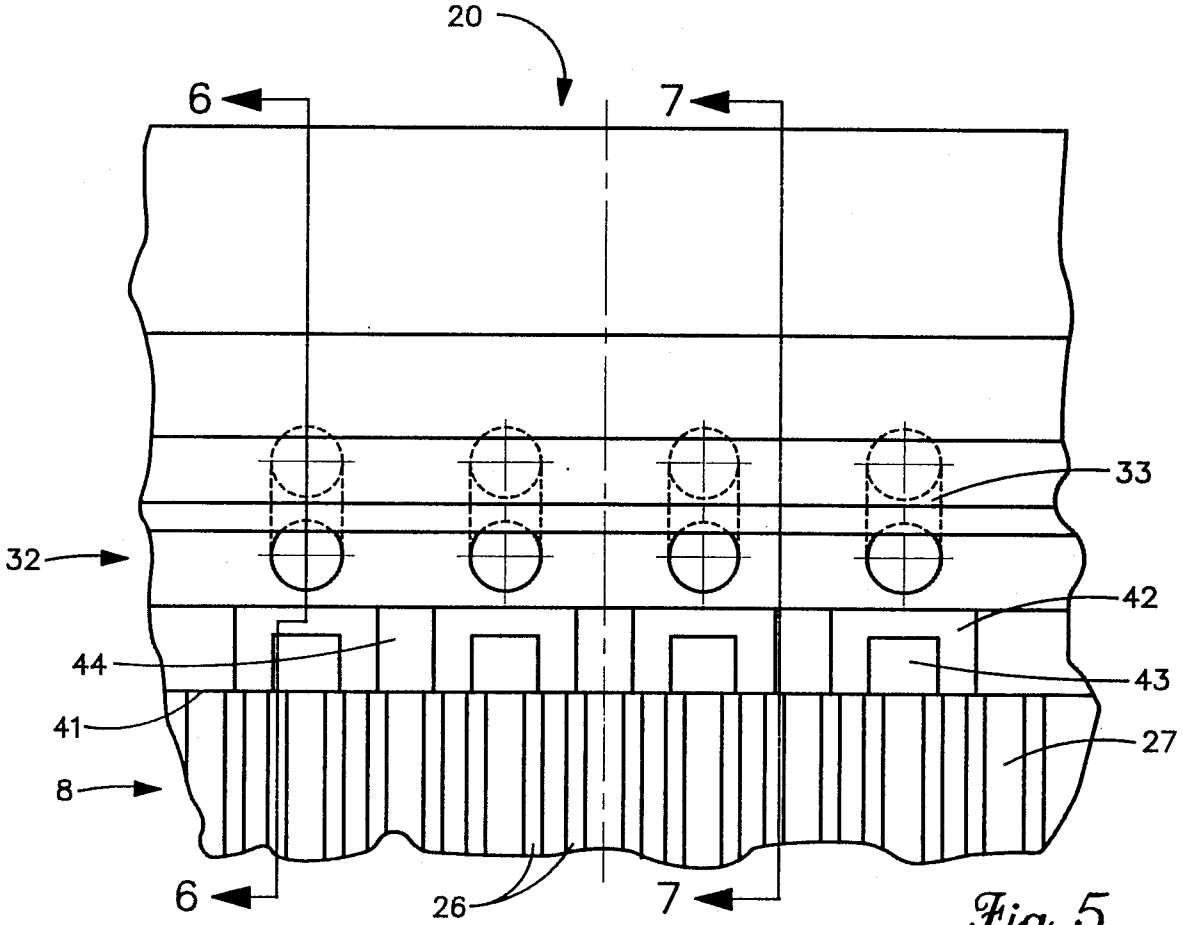
FIG. 5 is a view of the transition area from the roller core to the distributor ring, without the cooling jacket.

FIG. 5 shows more details of one embodiment of the invention which is especially favorable from the manufacturing standpoint, with cooling channels 26 running radially and traversed in alternating directions through channel pairs by cooling water. Roller body 8 with cooling channels 26 extending up to end face 41 is permanently connected to distributing flange 20. The roller shell, which is attached during operation and is not shown for clarity's sake, rests on shell surface 27 of roller body 8 and shell surface 42 of distributor flange 20, thereby sealing off cooling channels 26, pockets 44, distributing and collecting chambers 43 (depending on the flow direction of the cooling water), and outer annular channels 32.

The cooling water emerges from distributing chambers 43 and distributes itself through two adjacent cooling channels 26. At the other end face of the roller body the cooling water, now heated, is collected and conducted further by similarly designed collecting chambers 43. The distributing and collecting chambers 43 are cut out of the end face of distributor flange 20.

The heated cooling water flowing back from the other cooling channels 26 is conducted through channel pairs to outer annular channel 32 by pockets 44 which form an external opening through shell surface 42 of distributor flange 20. From here, the cooling water flows into the branch channels 33 which traverse distributor flange 20.

At the other end of the roller body, not shown, the cooling water emerges from similarly designed branch channels into the outer annular channel and passes through a pocket into the corresponding cooling channels 26. The heated cooling water flows out through a collecting chamber for each two cooling channels.

FIG. 5 shows the alternating arrangement of cooling channels 26 through channel pairs especially clearly.

Figure 6:
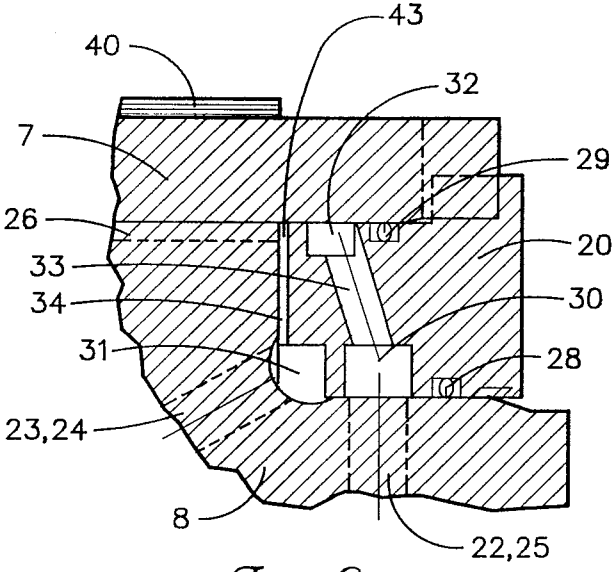
FIG. 6 is a lengthwise section along the VI—VI in FIG. 5.

FIG. 6 shows, on the one hand, the transition from a branch channel 34 supplying the cooling water to distributing chamber 43 and thence into one of the two cooling channels 26. On the other hand, the branch channel 33 that runs from outer annular channel 32 to the inner annular channel 30 adjacent to the end face, is shown.

Figure 7:
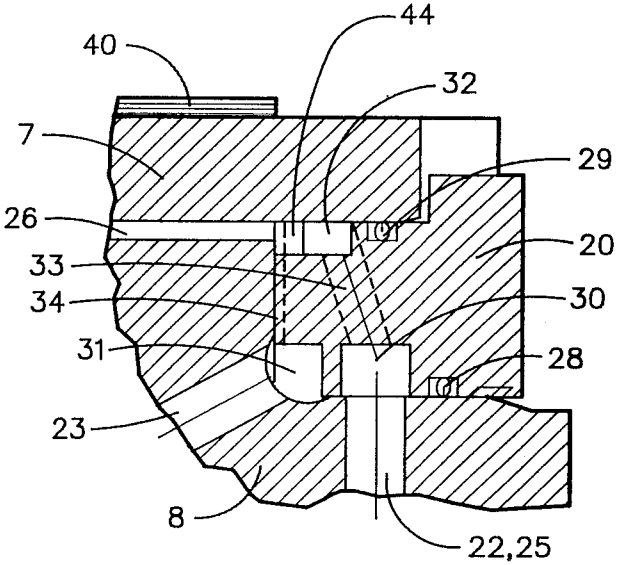
FIG. 7 is a lengthwise section along line VII—VII in FIG. 5.

Finally, FIG. 7 shows the transition of a cooling channel 26 carrying heated cooling water to pocket 44 and thence to outer annular channel 32.

What is claimed is:

1. A continuous casting roll apparatus having a cylindrically-shaped roller core substantially surrounded by a roller shell, comprising:

first cooling channel means formed in the outer surface of said roller core and extending from a first end of said roller core substantially parallel to the axis of said roller core to a second end of said roller core, second cooling channel means formed in the outer surface of said roller core and extending from said second end of said roller core substantially parallel to the axis of said roller core to said first end of said roller core, said first and second cooling channel means being substantially adjacent, coolant providing means for providing coolant at a first temperature to said first cooling channel means at said first end of said roller core, and for providing coolant at a temperature substantially the same as said first temperature to said second cooling channel means at said second end of said roller core, said coolant providing means comprising channel means located in said casting roll apparatus, coolant removing means for removing coolant from said first cooling channel means at said second roller end, and for removing coolant from said second cooling channel at said first roller end, said coolant removal means comprising channel means located in said casting roll apparatus.

2. The apparatus of claim 1, wherein said providing means comprise inlet central channel means located substantially centrally and axially in said roller core, inlet radial channel means positioned radially relative to and in fluid communication with said inlet central channel means, inlet annular channel means substantially concentrically arranged around the axis of said roller core and in fluid communication with said inlet radial channel means and adapted to transmit coolant to said first cooling channel means at said first end of said roller core and to transmit coolant to said second cooling channel means at said second end of said roller core.

3. The apparatus of claim 1, wherein said removal means comprise outlet annular channel means substantially concentrically arranged around the axis of said roller core and adapted to receive coolant from said first cooling channel means at said second end of said roller core and to receive coolant from said second cooling channel means at said first end of said roller core, outlet radial channel means positioned radially to and in fluid communication with said outlet annular channel means, and outlet central channel means substantially centrally and axially located in said roller core and in fluid communication with said outlet radial channel means.

4. The apparatus of claim 1, wherein said providing means comprises (a) axial channel means located substantially centrally and axially in said roller core, (b) first inlet branch bore means in fuid communication with and positioned radially relative to said axial channel means to first inlet inner annular channel means arranged substantially concentrically around said roller core axis, (c) first inlet branch channel means positioned radially relative to and in fluid communication with said first inlet inner annular channel means to inlet outer annular channel means arranged substantially concentrically around said roller core axis, said inlet outer annular channel means in fluid communication with said first cooling channel means at said first end of said roller core, (d) second inlet branch bore means radiating from and in fluid communication with said axial channel means to second inlet inner annular channel means arranged substantially concentrically around said roller core axis, and (e) second inlet branch channel means positioned radially relative to and in fluid communication with said second inlet inner annular channel means to inlet distributing and collecting chamber means arranged substantially concentrically around said roller core axis, said inlet distributing and collecting chamber means in fluid communication with said second cooling channel means at said second end of said roller core.

5. The apparatus of claim 1, wherein said coolant removal means comprises (a) outlet outer annular channel means arranged substantially concentrically around said roller core axis and in fluid communication with said first cooling channel means at said second end of said roller core, (b) first outlet branch channel means in fluid communication with and positioned radially relative to said outlet outer annular channel means to first outlet inner annular channel means arranged substantially concentrically around said roller core axis, (c) first outlet branch bore means in fluid communication with and positioned radially relative to said first outlet inner annular channel means to tubular channel means arranged substantially centrally and axially in said roller core, (d) outlet distributing and collecting chamber means arranged substantially concentrically around said roller core axis and in fluid communication with said second cooling channel means at said first end of said roller core, (e) second outlet branch channel means in fluid communication with and positioned radially relative to said outlet distributing and collecting chamber means to second outlet inner annular channel means arranged substantially concentrically around said roller core axis, (f) second outlet branch bore means in fluid communication with and positioned radially relative to said second outlet inner annular channel means to said tubular channel means.

6. The apparatus of claim 1, wherein said coolant providing means comprise a first and second distributor flange, each said flange being substantially concentrically arranged round the axis of said roller core, said first distributor flange adapted to provide coolant at a first temperature to said first cooling channel means at said first end of said roller core and said second distributor flange adapted to provide coolant at a temperature substantially the same as said first temperature to said second cooling channel means at said second end of said roller core, said first and second flanges being removable from said roller core and physically interchangeable with one another.

7. The apparatus of claim 6, wherein said coolant removal means comprise said first and second distributor flange means, said first distributor flange means adapted to receive coolant from said second-cooling channel at said first end of said roller core and said second distributor flange means adapted to receive coolant from said first cooling channel means at said second end of said roller core.

8. A continuous casting apparatus having a cylindrically-shaped roller core substantially surrounded by a roller shell, comprising:

first cooling channel means formed in the outer surface of said roller core and extending from a first end of said roller core substantially parallel to the axis of said roller core to a second end of said roller core, second cooling channel means formed in the outer surface of said roller core and extending from said second end of said roller core substantially parallel to the axis of said roller core to said first end of said roller core, said first and second cooling channel means being substantially adjacent, a first distributor flange for providing coolant at a first temperature to said first cooling channel means at said first end of said roller core, and for removing coolant from said second cooling channel at said first roller end, and a second distributor flange for providing coolant at a temperature substantially the same as said first temperature to said second cooling channel means at said second end of said roller core, and for removing coolant from said first cooling channel means at said second roller end, said first and second distributor flanges being removable from said roller core and physically interchangeable with one another.

9. In a roll casting apparatus having a cylindrically-shaped roller core with two end faces, a roller shell which substantially surrounds said roller core, and cooling channel means located in heat exchange relation with said roller shell, the improvement comprising a first and second distributor flange for providing coolant to and removing coolant from said cooling channel means, said first flange abutting the first end face of said roller core and said second flange abutting the second end face of said roller core, each of said flanges being removable from said roller core and physically interchangeable with one another, said distributor flanges each comprise a first and second inner annular channel, a first and second branch channel, an outer annular channel, a pocket and a distributing and collecting chamber, wherein said first inner annular channel is in fluid communication with said first branch channel, said outer annular channel is in fluid communication with said first branch channel and with said pocket, said distributing and collecting chamber is in fluid communication with said second branch channel, and said second inner annular channel is in fluid communication with said second branch channel.

10. A coolant distributing flange useful in connection with a roll casting apparatus having a cylindrically-shaped roller, a roller surface and cooling channels located in heat exchange relation with said roller surface, comprising:

a first and second inner annular channel, an inlet and outlet branch channel, a distributing and collecting chamber, on outer annular channel, and a pocket wherein said first inner annular channel is adapted to receive a first stream of coolant and transport said first stream through said inlet branch channel to said outer annular channel, said outer annular channel in fluid communication with said pocket to transport coolant to a first cooling channel, and said distributing and collecting chamber is adapted to receive a second stream of coolant from a second cooling channel to transport said second stream through said outlet branch channel to said second inner annular channel.

11. A coolant distributing flange useful in connection with a roll casting apparatus having a cylindrically-shaped roller, a roller surface and cooling channels located in heat exchange relation with said roller surface, comprising:

a first and second inner annular channel, an inlet and outlet branch channel, a distributing and collecting chamber, an outer annular channel, and a pocket wherein said pocket is adapted to receive a first stream of coolant from a first cooling channel and transport said first stream through said outer annular channel to said outlet branch channel, said outlet branch channel adapted to transport said first stream to said first inner annular channel, and said second inner annular channel is adapted to receive a second stream of coolant and transport said second stream through said inlet branch channel to said distributing and collecting chamber, said chamber adapted to transport said second stream to a second cooling channel.

12. A process for cooling of continuous casting rollers, comprising the steps of:

providing coolant by channel means located in said casting rollers at a first temperature to a first cooling channel means formed in the surface of a roller core and running substantially parallel to the roller core axis from a first end of the roller core to a second end, flowing said coolant through said first cooling channel means for said first end of said roller core to said second end of said roller core, removing said coolant from said first cooling channel at said second end of said roller core by channel means located in said casting rollers, providing coolant by channel means located in said casting rollers at a temperature substantially the same as said first temperature into second cooling channel means formed in the surface of said roller core and running substantially parallel and adjacent to said first cooling channel means, flowing said coolant through said second cooling channel means from said second end of said roller core to said first end of said roller core, wherein said coolant is initially at a temperature substantially the same as said first temperature, removing said coolant from said second cooling channel means at said first end of said roller core by channel means located in said casting rollers.

13. A process for cooling of continuous casting rollers, comprising the steps of:

introducing coolant into an inlet channel, said inlet channel and an outlet channel together comprising a central conduit, in a cooling roller having a roller core substantially surrounded by a roller shell;

distributing said coolant into first inlet and second inlet branch bores, said bores located in the roller core in fluid communication with and radiating from said inlet channel to a cooling channel at a first end of said roller core, said cooling channel consisting of an axial groove in the surface of said roller core extending from said first end of said roller core to a second end of said roller core;

flowing a first stream of said coolant from said first inlet branch bore into said first cooling channel at said first end of said roller core, and conducting said first stream of coolant through said axial groove while said coolant is in heat exchange contact with said roller shell;

simultaneously flowing a second stream of said coolant from said second inlet branch bore into a second cooling channel at said second end of said roller core, said second cooling channel consisting of an axial groove in the surface of said roller core extending from said second end of said roller core to said first end, and conducting said second stream of coolant through said second axial groove from said second end of said roller core to said first end while said coolant is in heat exchange contact with said roller shell, wherein the direction of flow of said second stream of coolant is in a direction opposite to the direction of flow of said first stream;

removing said first stream from said first cooling channel at said second end of roller core and removing said second stream of coolant from said second cooling channel at said first end of said roller core after said streams have passed through said cooling channels; and passing said first and second streams removed from said cooling channels to said outlet channel.

14. The process of claim 13, wherein:

said step of introducing said coolant into said inlet channel comprises introducing said coolant into a tubular channel; and said step of passing coolant to said outlet channel comprises passing said coolant to an axial channel.

15. The process of claim 13, wherein:

said step of introducing said coolant into said inlet channel comprises introducing said coolant into an axial channel; and said step of passing coolant to said outlet channel comprises passing said coolant to a tubular channel.

16. A continuous casting roll apparatus having a roller core substantially surrounded in length and circumference by a roller shell, comprising:

a first and a second end face of said roller core, each of said end faces forming the terminating surface of the cylindrically-shaped roller core, at least one pair of cooling channels which comprise a first cooling channel and a second cooling channel, said cooling channels consisting of adjacent, axial grooves in the surface of said roller core running parallel to the axis of said roller core from a first end of said roller core to a second end, said cooling channels being enclosed by said shell to enable said cooling channels to conduct coolant between roller shell and roller core;

a central conduit in said roller core, extending from said first end of said roller core axially to a point short of said second end, said conduit comprising an inlet channel and an outlet channel for supplying a coolant to and discharging said coolant from said cooling channels;

branch bores, located in said roller core in fluid communication with and radiating from said central conduit and terminating in said cooling channels, said branch bores comprising first and second inlet bores and first and second outlet bores, said first inlet bore being in fluid communication with said inlet channel to supply said coolant from said inlet channel to said first cooling channel at said first end of said roller core, said first outlet bore being in fluid communication with said first cooling channel at said second end of said roller core to discharge said coolant from said first cooling channel to said outlet channel and said second inlet bore being in fluid communication with said inlet channel to supply said coolant from said inlet channel to said second cooling channel at said second end of said roller core, said second outlet bore being in fluid communication with said second cooling channel at said first end of said roller core to discharge said coolant from said second cooling channel to said outlet channel.

17. The apparatus of claim 16, wherein:

said inlet channel comprises an axial channel and said outlet channel comprises a tubular channel.

18. The apparatus of claim 16, wherein:

said inlet channel comprises a tubular channel and said outlet channel comprises an axial channel.

19. The apparatus of claim 16, wherein:

said roller core having a first and a second shoulder, and a first and a second projection annular axial surface, wherein each said shoulder is that surface of the roller core located adjacent to and radially inward of each said end face, and each said projection annular axial surface is that surface of each projection that is continuous and adjacent to each said shoulder;

a first and a second distributor flange, said first flange abutting (a) said first end face, (b) said first shoulder, (c) said first projection annular axial surface of said roller core, and (d) an internal surface of said roller shell, and said second flange abutting (a) said second end face, (b) said second shoulder, (c) said second projection annular axial surface of said roller core, and (d) an internal surface of said roller shell, each said flange having (i) grooves in the face of said flange which abuts said end face of said roller core, (ii) annular channels, and (iii) branch channels, wherein:

said annular channels comprise a first inner annular channel, a second inner annular channel, and an outer annular channel, wherein said first inner annular channel is located in the flange surface abutting said roller core projection annular axial surface, said second inner annular channel is located at the flange face abutting the shoulder of the roller core, and said outer annular channel is located at the flange surface abutting the internal surface of said roller shell;

said grooves in said flange face abutting said roller end face comprise a distributing and collecting chamber, which is in fluid communication with said cooling channel and transmits coolant from said cooling channel to said outlet branch channel, and a pocket, which is in fluid communication with said outer annular channel to transmit coolant to said cooling channel.

said branch channels comprise an inlet branch channel, which radiates through the flange from said first inner annular channel to said outer annular channel, and an outlet branch channel, which radiates from said distributing and collecting chamber to said second inner annular channel along the flange surface abutting the end face of said roller core;

20. The apparatus of claim 19, wherein:

said inlet channel comprises an axial channel;

said first inlet bore is in fluid communication with said axial channel to transmit a first stream of coolant to said first inner annular channel of said first flange;

said inlet branch channel of said first flange is in fluid communication with said first inner annular channel of said first flange to transmit said first stream of coolant to said outer annular channel of said first flange;

said pocket of said first flange is in fluid communication with said outer annular channel of said first flange to transmit said first stream of coolant to said first cooling channel;

said pocket of said second flange is in fluid communication with said first cooling channel to transmit said first stream of coolant to said outer annular channel of said second flange;

said outlet branch channel of said second flange is in fluid communication with said outer annular channel of said second flange to transmit said first stream of coolant to said first inner annular channel of said second flange;

said first outlet bore is in fluid communication with said first inner annular channel of second flange to transmit said first stream of coolant to said tubular channel, and further comprising:

said second inlet bore is in fluid communication with said axial channel to transmit said second stream of coolant to said second inner annular channel of said second flange;

said inlet branch channel of said second flange is in fluid communication with said second inner annular channel of said second flange to transmit said second stream of coolant to said distributing and collecting chamber of said second flange;

said second cooling channel is in fluid communication with said distributing and collecting chamber of said second flange to transmit said second stream of coolant to said distributing and collecting chamber of said first flange;

said outlet branch channel of said first flange is in fluid communication with said distributing and collecting chamber of said first flange to transmit said second stream of coolant to said second inner annular channel of said first flange; and said second outlet bore is in fluid communication with said second inner annular channel of said first flange to transmit said second stream of coolant to said outlet channel, said outlet channel comprising a tubular channel.

21. The apparatus of claim 19, wherein:

said inlet channel comprises a tubular channel;

said first inlet bore is in fluid communication with said tubular channel to transmit a first stream of coolant to said first inner annular channel of said first flange;

said inlet branch channel of said first flange is in fluid communication with said first inner annular channel of said first flange to transmit said first stream of coolant to said outer annular channel of said first flange;

said pocket of said first flange is in fluid communication with said outer annular channel of said first flange to transmit said first stream of coolant to said first cooling channel;

said pocket of said second flange is in fluid communication with said first cooling channel to transmit said first stream of coolant to said outer annular pocket of said second flange;

said outlet branch channel of said second flange is in fluid communication with said outer annular channel of said second flange to transmit said first stream of coolant to said first inner annular channel of said second flange;

said first outlet bore is in fluid communication with said first inner annular channel of said second flange to transmit said first stream of coolant to said axial channel, and further comprising:

said second inlet bore is in fluid communication with said tubular channel to transmit said second stream of coolant to second inner annular channel of said second flange;

said inlet branch channel of said second flange is in fluid communication with said second inner annular channel of said second flange to transmit said second stream of coolant to said distributing and collecting chamber of said second flange;

said second cooling channel is in fluid communication with said distributing and collecting chamber of said second flange to transmit said second stream of coolant to said distributing and collecting chamber of said first flange;

said outlet branch channel of said first flange is in fluid communication with said distributing and collecting chamber of said first flange to transmit said second stream of coolant to said second inner annular channel of said first flange; and said second outlet bore is in fluid communication with said second inner annular channel of said first flange to transmit said second stream of coolant to said outlet channel, said outlet channel comprising an axial channel.

* * * * *

UNITED STATES PATENT AND TRADEMARK OFFICE

CERTIFICATE OF CORRECTION

PATENT NO. : 4,944,342

DATED : July 31, 1990

INVENTOR(S) : Wilhelm F. Lauener

It is certified that error appears in the above-identified patent and that said Letters Patent is hereby corrected as shown below:

Column 2, line 48, delete "such" and insert therefor --each--.

Column 3, line 67, delete the comma after the first occurrence of "channels".

Column 6, line 46, delete "fuid" and insert therefor --fluid--.

Column 7, line 45, delete "second-cooling" and insert therefor --second cooling--.

Column 9, line 14, delete "for" and insert therefor --from--.

Signed and Sealed this

Twenty-seventh Day of August, 1991

*Attest:*

*Attesting Officer*

HARRY F. MANBECK, JR.

*Commissioner of Patents and Trademarks*